US006119422A

United States Patent [19]

Clear et al.

[11] Patent Number: 6,119,422

[45] Date of Patent: Sep. 19, 2000

[54] IMPACT RESISTANT BUILDING PANELS

[75] Inventors: Theodore E. Clear; Terrence L. Clear, both of Hamilton; David L. Roodvoets, Westerville, all of Ohio

[73] Assignee: Fin-Pan, Inc.

[21] Appl. No.: 08/965,750

[22] Filed: Nov. 7, 1997

[51] Int. Cl.[7] ..... B04B 2/20

[52] U.S. Cl. ..... 52/309.8; 52/268; 52/309.9; 52/309.12; 52/309.17

[58] Field of Search ..... 52/265, 268, 269, 52/309.9, 309.12, 309.14, 309.17, 794.1; 82/309.8

[56] References Cited

U.S. PATENT DOCUMENTS

| | | | |
|---|---|---|---|
| Re. 32,037 | 11/1985 | Clear . | |
| Re. 32,038 | 11/1985 | Clear . | |
| 2,728,702 | 12/1955 | Simon et al. | 52/309.9 X |
| 3,816,234 | 6/1974 | Winfield | 52/309.9 X |
| 4,203,788 | 5/1980 | Clear . | |
| 4,281,952 | 8/1981 | Clear . | |
| 4,420,295 | 12/1983 | Clear . | |
| 4,455,801 | 6/1984 | Merritt | 52/265 X |
| 4,646,498 | 3/1987 | Schneller et al. | 52/309.12 |
| 5,335,472 | 8/1994 | Phillips | 52/309.12 X |
| 5,522,194 | 6/1996 | Graulich | 52/309.12 X |
| 5,647,180 | 7/1997 | Billings et al. | 52/268 |
| 5,740,643 | 4/1998 | Huntley | 52/309.12 X |
| 5,763,043 | 6/1998 | Porter et al. | 52/309.17 X |
| 5,809,725 | 9/1998 | Cretti | 52/309.17 X |

*Primary Examiner*—Richard Chilcot
*Attorney, Agent, or Firm*—Wood, Herron & Evans LLP

[57] ABSTRACT

A composite building panel includes an impact resistant adhesively bonded mesh web which, in combination with other panel features, prevents impact penetration by defined projectiles moving at defined energies. Various embodiments include cementitious panels modified with the new web or used in conjunction with the new web to form structural wall and roof panels, some insulated with foam components.

16 Claims, 2 Drawing Sheets

IMPACT RESISTANT BUILDING PANELS

This invention relates to wall and roofing panels and particularly to such reinforced panels useful for a variety of building applications.

Reinforced cementitious panels of the type comprising a relatively lightweight aggregate cementitious core faced on each side with a reinforcing fiberglass mesh, bathed during manufacture in a slurry of neat cement and then applied to the core and cured, are known for many applications. These include use as backer board for ceramic tile and as facings for composite building panels having such a cementitious panel facing at least one side of a foam component for insulation. Such cementitious panels are described, for example, in U.S. Pat. Nos. 4,203,788; 4,281,952; 4,420,295; 3,284,980; Re. 32,037; Re. 32,038; and Re. 31,921, expressly incorporated herein by reference. Such combined cementitious and foam panels are described, for example, in U.S. Pat. Nos. 4,944,127; 4,054,691 and 4,067,164, also expressly incorporated herein by reference.

One such fiberglass mesh reinforced cementitious panel is manufactured and sold under the trademark "UTIL-A-CRETE" by Fin-Pan, Inc. of Hamilton, Ohio.

Such panels are certified for numerous uses in a variety of applications by various state and national certification agencies. Nevertheless, there are certain building standards for which such panels are not approved. For example, in states such as Florida where geographic location subjects buildings and homes to high winds, perhaps of hurricane force, new standards require walls and building panels to withstand certain impacts, such as from a wooden eight foot long two-by-four weighing about 8.5 pounds and impacting endwise on the panel face at 34 miles per hour (about 50 feet per second). After such impact, the impacted area must resist at least one-third the vacuum pressure the panel resisted before impact, starting at a pre-impact minimium of about 90 pounds per square foot. The current fiberglass mesh reinforced panels such as certain ones of those described above, in either single reinforced panel, or panel and foam configuration, do not pass this standard, even though such panels are very strong. Walls comprising such panels must thus also include additional structural back-up, such as concrete block in order to pass the new standards.

Accordingly, it has been one objective of this invention to provide improved cementitious panels providing impact resistance suitable for use in high wind areas subject to hurricane force winds.

A further objective of the invention has been to provide improved composite wall and roofing panels with improved impact and penetration resistant capacity.

A further objective of the invention has been to provide improved building panels for use in forming structural walls of building and residences.

A further objective has been to provide improved insulated walls panels having resistance to impacts typical of those occurring in tropical storms and hurricanes.

It is also acknowledged that there are today available certain building systems known as "EIFS" which is short for "Exterior Insulated Finish System". Such systems, for example, comprise a composite of components such as an outside stucco finish, a fiberglass mesh, foam insulation, gypsum, and then some further structural support such as studs, frames or the like. Such EIFS units are thus relatively soft when compared to cementitious panels. They are subject to damage and penetration by stones thrown by cars or mowers or by people, and do not pass the new impact standards mentioned above.

Accordingly, a further objective of the invention has been to provide an improved insulated exterior finish panel offering more resistance to damage and penetration than the prior EIFS units.

To these ends, the invention comprises, in one embodiment, a composite insulated panel comprising a thickness of insulating foam as a core, a fiberglass mesh reinforced cementitious panel disposed on the exterior thereof, a plywood sheet adhered to an interior face thereof, and a further reinforcing, impact resistant coated nylon mesh adhered between the cementitious panel and the foam core. The addition of the impact resistant mesh of coated nylon between the cementitious panel and the foam core provides a composite wall panel capable of preventing panel penetration by an eight foot long two-by-four weighing about 8.5 pounds and impacting the panel face endwise at 34 miles per hour, and providing a vacuum resistance through the panel after impact of at least one-third the resistance prior to impact, which was in excess of 90 psf.

In another embodiment of the invention, the cementitous panel is modified by substituting the impact resistant coated nylon mesh for the interior side reinforcing fiberglass mesh in the reinforced cementitious panel. This modified cementitious panel is then adhered to the foam core backed by the plywood sheet. Such panel is also capable of withstanding the noted two-by-four impact and vacuum test.

In a still further embodiment of the invention, a strong structural building panel comprises, from the interior side, a fiberglass mesh reinforced cementitious panel adhered to the interior face of a foam core and a modified reinforced cementitious panel adhered to the exterior face of the foam core. The modified cementitious panel has an outer facing of fiberglass reinforcing mesh and an inner facing of impact resistant coated nylon mesh in place of the typical fiberglass reinforcing mesh. Such a structural panel is also capable of withstanding the noted two-by-four impact and vacuum test.

Such panels can be used as vertical building panels or facings, structural panels, roofing panels and the like. Use of the impact resistant coated nylon mesh makes the composite panels useful in load-bearing applications such as in roofing panel applications.

In yet a further embodiment of the invention, the impact resistant coated nylon mesh is adhered directly to a foam core. A siding, such as aluminum or vinyl, is applied over such panel. This panel too is capable of withstanding the noted impact and vacuum test.

The invention contemplates other embodiments as well. These include composite panels where two reinforced cementitious panels are adhered to a foam core with an impact resistant nylon mesh between the outermost cementitious panel and the foam; where in impact resistant nylon mesh is adhered between two cementitious panels, and where an impact resistant nylon mesh is adhered between a reinforced cementitious subpanel and a foam subpanel and this sub-assembly is secured to a structure such as wall studs and interior dry wall.

All such panels as described herein are capable of passing the noted impact and vacuum tests.

These and other objects of the invention will be appreciated by the following written description of preferred and alternative embodiments of the invention and from the drawings, in which.

Turning now to the drawings, there are shown therein several alternative embodiments according to the inventions.

Figure 1:
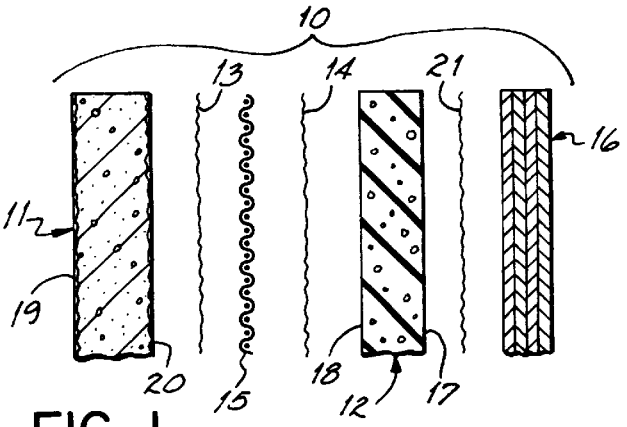
FIG. 1 is an exploded view of one embodiment of the invention.
Figure 2:
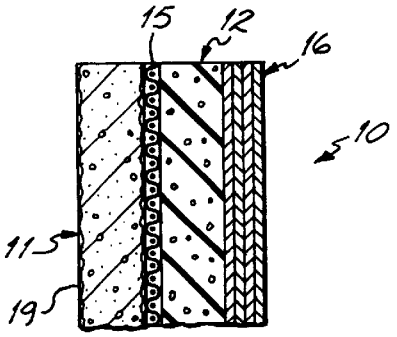
FIG. 2 is a partial cross-sectional view of an assembled panel according to FIG. 1.

First, turning to FIGS. 1 and 2, there is shown therein a composite building panel 10 shown in exploded form in FIG. 1 and in assembled form in FIG. 2. Such a building panel, as well as the other panel and wall structures disclosed herein, provide a substantial amount of resistance to exterior impact so as to meet, for example, those standards for resisting impact in high wind areas.

One such test, for example, is the resistance of a panel or wall structure in question to penetration from the impact on the exterior side of the panel of a wooden two-by-four, eight feet long, weighing 8.5 pounds and moving endwise at 34 miles per hour. For purposes of clarity, such test will be hereinafter referred to as the "Impact Test".

In order to pass such an "Impact Test", the panel structure subjected to such impact must be able to withstand at least one-third the total vacuum pressure applied to such panel prior to such impact. More particularly, a vacuum pressure is applied to a fresh panel before the impact of such a 2×4. A measure is taken of the resistance of such panel to the vacuum as measured in pounds per square foot. After such impact, a vacuum is again applied over the impacted area and the panel must produce a resistance to the vacuum of at least one-third the prior measure taken on the fresh panel.

For example, in the State of Florida, a fresh panel before impact must withstand a minimum vacuum pressure of 90 pounds per square foot and a minimum of 30 pounds per square foot in the impact area after the impact of such a 2×4. For clarity, this test will hereinafter be referred to as the "Florida Vacuum Test."

Panel 10 shown in FIG. 1 and 2 is a composite cementitious panel of a multiple number of components or subpanels. The panel 10 includes a reinforced cementitious panel 11 of the type having a lightweight aggregate core faced on inner and outer faces with a fiberglass mesh reinforcing web which, during manufacture, is bathed in a neat cement and then applied to the aggregate core, where the webs are adhered to the core to form an integral panel 11 used as a subpanel within the building panel 10 of FIG. 1. Such a reinforced cementitious subpanel is manufactured by Fin-Pan, Inc. of Hamilton, Ohio under its mark, "UTIL-A-CRETE" as is further described in part in U.S. Pat. Nos. Re. 32,037; Re. 32,038; Re. 31,921 and 4,420,295.

Subpanel 11 is disposed on the exterior side of a foam core 12, such as an insulating foam material preferably about 0.5" to about 4 inches thick even though thinner or thicker components can be used. Such foam material can be expanded polystyrene such as obtained from the Dow Chemical Corporation and preferably complying with ASTM standard D-478 Type IV or Type VI.

The subpanel 11 is adhesively bonded to the foam core 12 by means of intermittent layers of adhesive 13 and 14 disposed on either sides of an impact resistant mesh material 15.

Impact resistant mesh material 15 is preferably a woven coated nylon material. Specifically, one such material comprises a vinyl (PVC) coated woven nylon mesh of about 11 strands per inch warp by about 11 strands per inch fill providing a mesh of about 1680 denier. The finished coated nylon multi-filament strands making up such mesh are about 0.031" in diameter.

One such suitable nylon is 1680 denier nylon 6.6 Type 728 obtained from the DuPont Company and coated with vinyl known as 577 bark. Such mesh is available from Phifer Wire Products, Inc. of Tuscaloosa, Ala.

In further description of such mesh, it has a mesh weight, according to ASTM 3776 of about 14.5 ounces per square yard. Tensile strength according to ASTM 5035/1682 (cut strip method) is about 310 pounds per inch. Elongation according to ASTM 5035/1682 (cut strip method) is about 31.0 ∓9 percent in three inches for the warp component and about 33.0 ∓9 percent in three inches for the fill component. Tearing strength using the trapezoid method, ASTM D-1117 Section 14.9 warp 100 minutes and ASTM D-2262 Section 10.1 fill 100 minutes. Fabric thickness, ASTM D-1777 is about 0.047 inches (∓0.005). Finally, the burn rate does not exceed four inches per minute.

Other suitable mesh materials might be utilized, however, fiberglass mesh of the type typically used in the "UTIL-A-CRETE" panels has been found not suitable or operable when the composite must pass the Impact Test. Panels made up according to the combinations described herein but with fiberglass mesh as opposed to a reinforced impact-resistant mesh such as herein disclosed, do not meet the "Impact Test." Accordingly, the term "impact resistant mesh" as used herein means a mesh material which, when assembled in a panel, wall or roof assembly as described herein, will provide sufficient impact resistant performance in such an assembly as to withstand and pass the "Impact Test" and the associated "Florida Vacuum Test."

Accordingly, the subpanel 11 is adhesively bonded to the exterior side 18 of the foam core panel 12 by means of the adhesive 13 and 14 and the intervening layer of mesh 15. A plywood sheet or subpanel 16 is provided and is adhesively bonded to the interior face 17 of the foam core 12 by means of the adhesive 21. The finished and composite panel is shown assembled in FIG. 2

It will be appreciated that the components 11 and 16 of the panel 10 can be manufactured independently and thereafter cut and adhered together and formed as shown in FIG. 2 by means of a laminating operation whereby the mesh 15 is captured between adhesive layers 13 and 14 between the foam subpanel 12 and the subpanel 11. In this regard, it will be appreciated that the subpanel 11 has an outer face 19 and inner face 20, to which the adhesive layer 13 bonds.

In use, the composite panel 10, such as shown in FIG. 2 can be nailed or otherwise secured to studs (not shown) and used as the exterior panel on a building or residence structure, for example, or otherwise used to independently form a building wall, for example. The intervening mesh 15 provides sufficient performance to the panel so that the panel cannot be punctured or penetrated by the "Impact Test" and so that it will also pass the so-called "Florida Vacuum Test." Indeed, the resistance of the fresh panel 10 to vacuum is about 345 pounds per square foot and the resistance after the impact noted above is greater than about 114 pounds per square foot.

Figure 3:
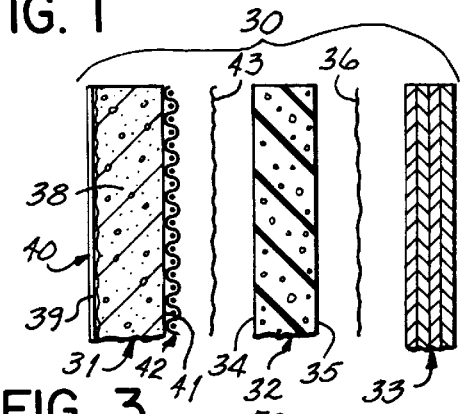
FIG. 3 is an exploded view of another embodiment of the invention.
Figure 4:
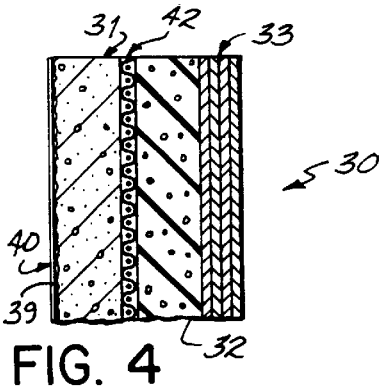
FIG. 4 is a partial cross-sectional view of an assembled panel according to FIG. 3.

Turning now to another embodiment of the invention, attention is drawn to FIGS. 3 and 4 wherein a composite panel 30 is described. FIG. 3 shows the composite panel 30 in exploded form, while FIG. 4 shows the composite panel 30 in assembled form. The composite panel 30 includes an exterior cementitious subpanel 31, a foam core 32 and a plywood backup panel 33. The foam core 32 has exterior and interior faces 34 and 35, respectively. The plywood panel 33 is adhesively bonded by adhesive layer 36 to the interior face 35 of the foam core subpanel 32.

The cementitious subpanel 31 includes a lightweight aggregate core 38. To the outer face 39 is bonded a reinforcing mesh material 40, similar to the initial fiberglass mesh of subpanel 11 (FIG. 1). Bonded to the inner face 41 of the core 38, however, is an impact resistant reinforcing mesh web 42 of a material like that of mesh 15 (FIG. 1). This web 42 has replaced the typical fiberglass mesh otherwise comprising the interior face of subpanel 31.

The subpanel 31, as described, is adhered or adhesively bonded to the exterior face 34 of the foam panel 32 by an adhesive layer 43. When the composite panel 30 is laminated together, it forms a strong, impact resistant building panel which may be utilized, for example, like panel 10, such as against the studs of a building or a residence, in order to provide a substantial wall structure which is capable of passing the heretofore described "Impact Test".

As noted above, the individual components of panel 30 can be separately manufactured and then combined in a laminating operation, so panel 30 can be supplied in a ready-to-use configuration.

Figure 5:
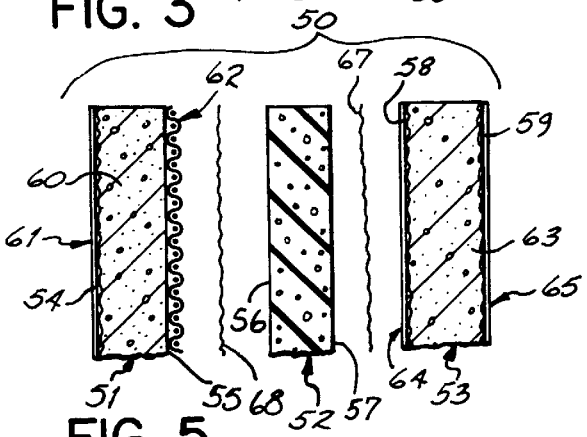
FIG. 5 is an exploded view of another embodiment of the invention.
Figure 6:
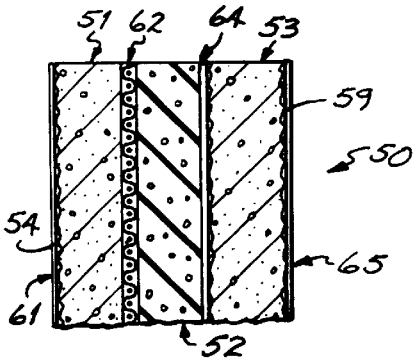
FIG. 6 is a partial cross-sectional view of an assembled panel according to FIG. 5.

Turning now to a further alternative embodiment, a panel 50 according to the invention, is shown in FIGS. 5 and 6. The composite panel shown in FIG. 5, for example, includes a cementitious subpanel 51, like that of subpanel 31 in FIG. 3, a foam core 52 and a further cementitious subpanel 53. Cementitious panel 51 has outer and inner faces 54 and 55. The foam core subpanel 52 has exterior face 56 and an interior face 57. Cementitious panel 53 has an external side or face 58 and internal side or face 59.

Returning now to the subpanel 51, it will be appreciated that this panel is similar to the subpanel 31 shown in FIG. 3, having an aggregate core 60 faced on outer face 54 with a reinforced fiberglass mesh material 61 and on an inner face 55 with a second mesh 62 of different material, such as that mesh 15 described with respect to FIG. 1. Both of these meshes are, during manufacture, bathed in a slurry of neat cement and applied to the uncured aggregate core to form the subpanel 51, just as subpanel 31 of FIG. 3 is made.

Turning now to the cementitious panel 53, this is a mesh reinforced cementitious panel, such as disclosed in U.S. Pat. Nos. Re. 32,037; Re. 32,038; Re. 31,921 and 4,420,295, like subpanel 11 of FIG. 1.

This panel has, as illustrated, a lightweight aggregate core 63 and fiberglass reinforced mesh facings 64 and 65 on each side thereof. During manufacture, the mesh webs 64 and 65 are run through a slurry of neat cement and adhered to the light aggregate core. The panel is then cut and cured, forming the subpanel 53.

Considering the overall composite panel 50, the foam core 52 is adhered by a layer of adhesive 67 to the subpanel 53. The subpanel 51 is disposed against an exterior face 56 of the foam panel 52 by means of the adhesive layer 68, so that the subpanels 51, 52 and 53 are bonded adhesively together, such as shown in FIG. 6. As such, the panel can be used as a stand alone structural building panel with cementitious faces comprising the subpanels 51 and 53 and being insulated. At the same time, the structural wall panel can withstand, by virtue of the utilization of the mesh 62 on one side of the panel 51, and preferably on the interior side thereof, the heretofore described "Impact Test" and "Florida Vacuum Test" and, therefore, will meet certain standards concerning impact resistance for utilization of the panel as a building panel in high wind areas. As with other embodiments, the components can be separately manufactured and combined in a laminating operation so the panel 50 can be supplied in ready-to-use configuration.

Figure 7:
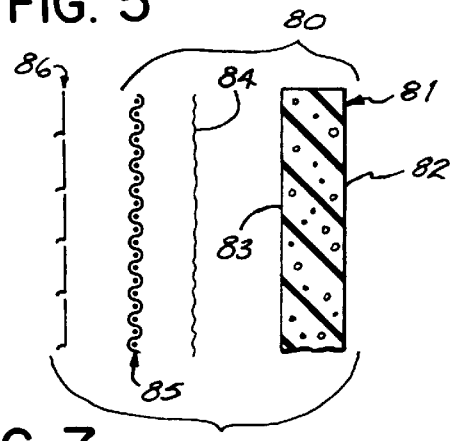
FIG. 7 is an exploded view of another embodiment of the invention.
Figure 8:
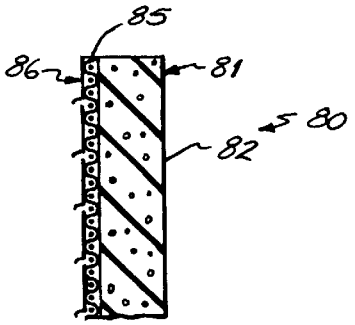
FIG. 8 is a partial cross-sectional view of an assembled panel according to FIG. 7.

Turning now to a further alternative embodiment of the invention, there is disclosed in FIGS. 7 and 8 another composite panel 80 comprising a foam component 81 having internal and external sides 82 and 83. A layer of adhesive 84 secures a mesh material 85 to the exterior face 83 of the subpanel 81. The mesh 85 is like that mesh 15 as described with respect to FIG. 1. Optionally secured to the exterior side of this panel is a siding, such as siding 86. Siding 86 may comprise any kind of siding suitable for use in the environment in which the panel will be used, such as aluminum or vinyl siding comprising overlapped boards, for example, as illustrated in FIG. 7. The siding may be placed on each individual composite panel 80 to form a plurality of composite panels, including the foam component 81, the mesh 85 and the siding 86; or the siding 86 may be mounted over a plurality of composite panels 80, which are formed into a wall, such as by mounting on studs or the like (not shown). Siding 86, of course, may take any suitable form, such as aluminum, wood, brick veneer or other appropriate materials.

As noted with respect to the other embodiments of the invention, the panel 80, when provided with the siding, including even a lightweight siding such as aluminum, will pass the heretofore described "Impact Test" and "Florida Vacuum Test" and will thus satisfy certain standards for penetration resistances required for the use of building panels in high wind areas. Also, the mesh and foam components may be combined and supplied in panels 80 for use, or panels 80 with siding 86 attached can be supplied for use in panel form.

Figure 9:
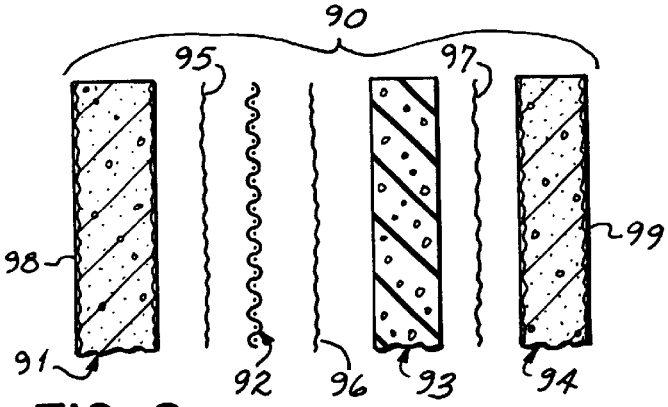
FIG. 9 is an exploded view of another embodiment of the invention.
Figure 10:
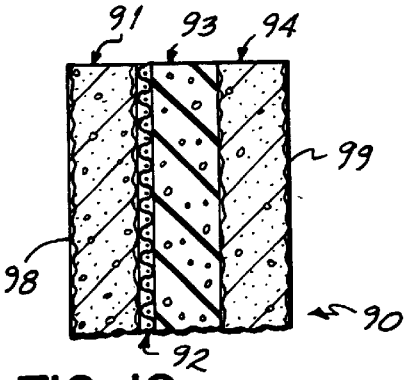
FIG. 10 is a partial cross-sectional view of an assembled panel according to FIG. 9.

A further embodiment of the invention is shown in FIGS. 9 and 10. A composite cementitious and insulated impact resistant panel 90, is comprised of a plurality of subcomponents including a fiberglass mesh reinforced cementitious panel 91 similar to panel 11 described above, an impact resistant mesh 92 similar to mesh 15 described above, a foam core 93 and a further fiberglass mesh reinforced cementitious panel 94 like panel 91. The impact resistant mesh 92 is sandwiched between the subpanel 91 and the foam 93 and held there by suitable bonding or adhesive agents, such as a mastic, as shown at 95 and 96. The fiberglass reinforced subpanel 94 is adhered to interior surface of the foam core 93 by a mastic or other suitable bonding agent, such as shown at 97.

This assembled panel is shown in FIG. 10 and has generally exterior side 98 and an interior side 99. Such a panel 90 is very strong and can be used as a structural panel in walls, floors, ceilings or roofs of structures. The utilization of the impact resistant mesh 92 provides a panel having an impact resistance sufficient to pass the aforementioned "Impact Test", including the "Florida Vacuum Test."

Figure 11:
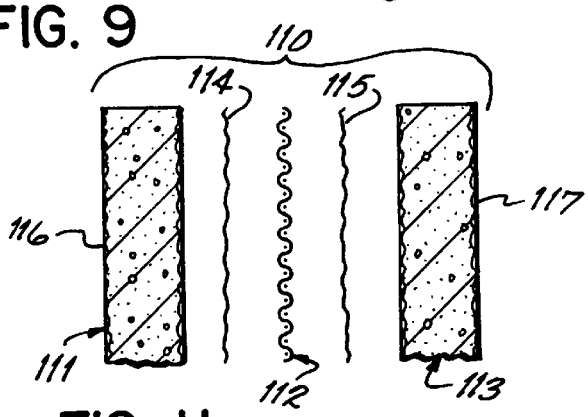
FIG. 11 is an exploded view of another embodiment of the invention.
Figure 12:
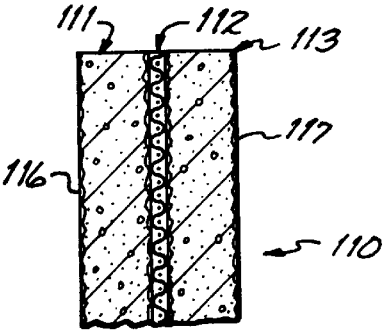
FIG. 12 is a partial cross-sectional view of an assembled panel according to FIG. 11.

Turning now to yet another embodiment of the invention, there is shown in FIG. 11 a composite panel 110. This panel does not include an insulation layer. It does, however, comprise a plurality of subcomponents, including a fiberglass mesh reinforced cementitious panel 111, an impact resistant nylon mesh 112 and a further fiberglass mesh reinforced cementitious panel 113. The components are held together by mastic layers at 114 and 115, disposed on each side of the mesh 112 and between the mesh and the respective cementitious panels 111 and 113. Such a panel has two sides, 116 and 117, both of which provide either interior or exterior faces thereof, this panel being reversible in its application. This panel can also be utilized as a structural wall panel, as a floor panel, or as a ceiling or a roof panel. This panel, too, presents sufficient resistance to impact, such as to pass the "Impact Test" described above and the associated "Florida Vacuum Test", also as described above.

Figure 13:
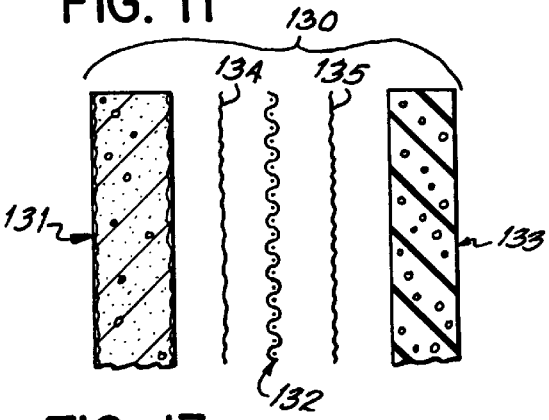
FIG. 13 is an exploded view of another embodiment of the invention.
Figure 14:
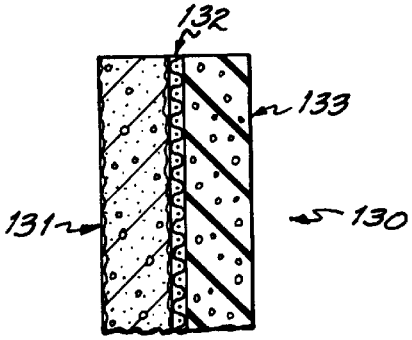
FIG. 14 is a partial cross-sectional view of an assembled panel according to FIG. 13.
Figure 15:
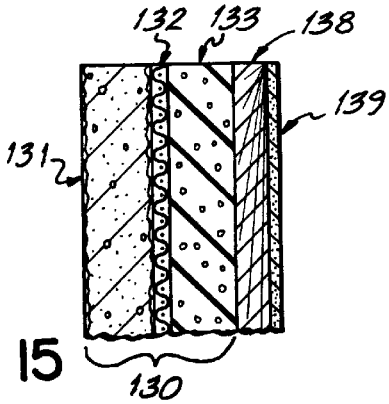
FIG. 15 is an illustrative view of the embodiment of FIGS. 13 and 14 as used in a conventional frame wall construction.

Turning now to yet another embodiment of the invention, as shown in FIGS. 13–15, there is shown in FIG. 13 a composite panel 130 comprised of a plurality of subcomponents including fiberglass mesh reinforced cementitious panel 131, an impact resistant mesh 132 and insulating foam component 133. The mesh 132 is mounted between the subpanels 131 and 133 and held there by means of mastic or suitable bonding agents 134, 135.

The fiberglass mesh reinforced cementitious panel 131 is like subpanels 11, 91, 94, 111 and 113, described above with respect to other embodiments of the invention. Likewise, the impact resistant nylon mesh 132 is like that described above with respect to mesh 15, 42, 62, 85, 92 and 112, all as described above.

FIG. 14 shows such a panel in a diagrammatic assembled form.

FIG. 15 illustrates such a panel 130 as used, for example, as a wall panel. In FIG. 15 the panel 130 is shown assembled to a frame wall, such as to the studs 138 thereof. Gypsum or wallboard 139 has been applied to the interior of the studs so that the entire structural wall comprises the panel 130 and the stud frame made up of studs 138 and the interior surface finish, such as gypsum or drywall 139.

It will be appreciated that this panel 130 can likewise be used as a wall panel or as a roof, ceiling or floor panel and that it too has the capacity to pass the above-identified "Impact Test" and the associated "Florida Vacuum Test."

It will be appreciated that many of these panels can be utilized to provide building panels which, joined together, form entire building walls. For example, the panels can be joined together by means of the application or the cutting of grooves into the foam cores associated with the respective panels and then elongated steel or metallic tongues inserted into the grooves of each adjacent panels so that screws or other fasteners can be applied through the panels and into the metal tongues, thereby securing the panels together to form an integral, insulated structural wall, ceiling, roof or flooring system.

Such an interconnection system and application is described in a copending U.S. patent application Ser. No. 08/518,196 filed on Sep. 7, 1995, entitled "WALL PANELS AND JOINT STRUCTURES" specifically incorporated herein by reference.

It will also be appreciated that the composite panels as described herein might also be used as roofing panels, the additional meshes 15, 42, 62, 85, 92, 112 and 132 serving to strengthen the panels and make them suitable for use as roofing panels or other structural panels where enhanced load bearing and impact resistance is desirable.

It will also be appreciated that the utilization of the meshes in the various embodiments, such as meshes 15, 42, 62, 85, 92, 112 and 132 enhances the strength of the composite panels described. In particular, it was found that cementitious or other panels which are not enhanced by such meshes, or which are not used in connection with the addition of such meshes, such as illustrated in FIG. 1, do not withstand the "Impact Test" described above and that the particular nylon mesh described above is particularly effective in providing the desirable impact resistance parameters to the panels as described.

It will also be appreciated that the panels can be utilized with any suitable other structural framing to provide enclosed buildings or residences, or can be utilized as desired in stand alone configuration, preferably as described with respect to the panels of FIGS. 1–6 and 9–15, to provide structural load bearing walls, and to provide roofs or ceilings for utilization in buildings and residence structures.

It will also be appreciated that any suitable mastic, adhesive or bonding agent can be used as the layers noted at 13, 14, 36, 43, 67, 68, 84, 95, 96, 114, 115, 134 and 135.

It should also be appreciated that the mesh material 15, 42, 62, 85, 92, 112 and 132 particularly when used with uncured cementitious slurries on materials, are resistant to degeneration by such materials. This parameter is particularly important, for example, to the embodiment of FIGS. 3–6, but may not be necessary in the embodiments of FIGS. 1–2 and 7–15, for example.

It will also be appreciated that while each of the panels described herein pass the "Impact Test", the panels are all preferably impacted on the so-called exterior sides, i.e. the sides to which the impact resistant mesh is generally the closest.

Finally, it will be appreciated that the panels can all be finished interiorly or exteriorly with any suitable finish treatment, including but not limited to stucco, texturizing, siding, painting, coatings, veneers, coverings and the like.

These and other advantages and modifications will become readily apparent to those of ordinary skill in the art without departing from the scope of the invention, and the applicants intend to be bound only by the claims appended hereto.

What is claimed:

1. An impact resistant building panel comprising:

a foam core having interior and exterior faces;

a cementitious subpanel including an aggregate core and first and second mesh reinforcing webs on both sides thereof;

a third impact resistant mesh web disposed between said cementitious subpanel and an exterior face of said foam core; and said foam core, cementitious subpanel and third mesh web being adhesively bonded together to form an impact resistant building panel.

2. A panel as in claim 1 further including a wood subpanel adhesively bonded to an interior face of said foam core.

3. A panel as in claim 2 wherein said third mesh web comprises woven nylon mesh.

4. An impact resistant building panel comprising a foam core having interior and exterior sides;

a cementitious subpanel including an aggregate core having inner and outer faces, a first reinforcing mesh web adhered to an outer face of said aggregate core and a second impact resistant mesh web of a different material from said first mesh web adhered to an inner face of said aggregate core;

said subpanel's second mesh web being adhesively bonded to an exterior face of said foam core.

5. A panel as in claim 4 further including a wood subpanel adhesively bonded to an interior face of said foam core.

6. A panel as in claim 4 wherein said second web comprises woven nylon mesh.

7. An impact resistant building panel comprising a foam core having exterior and interior faces; and a cementitious subpanel having reinforced facings;

an impact resistant mesh web adhesively bonded between an exterior face of said foam core and a reinforced face of said subpanel.

8. A panel as in claim 7 wherein said mesh web is a woven nylon mesh.

9. A building panel as in claim 7 further including a siding disposed over said panel when said panel comprises an element of a wall.

10. An impact resistant building panel comprising:

a cementitious subpanel having reinforced facings;

an impact resistant mesh; and a foam sub panel;

said cementitious subpanel and said foam subpanel being adhered together with said mesh adhered therebetween.

11. A panel as in claim 10 wherein said impact resistant mesh is a woven nylon mesh.

12. A panel as in claim 10 wherein said cementitious subpanel comprises an aggregate core having first and second reinforcing webs on both sides thereof.

13. An impact resistant building panel comprising:

a foam core having interior and exterior faces;

a cementitious subpanel including an aggregate core and first and second mesh reinforcing webs on both sides thereof;

a third impact resistant mesh web disposed between said cementitious subpanel and an exterior face of said foam core; and said foam core, cementitious subpanel and third mesh web being adhesively bonded together to form an impact resistant building panel, capable of preventing penetration therethrough in an impact area engaged by an impacting wooden two by four, eight feet long, weighing approximately 8.5 pounds and moving endwise at 34 miles per hour, and thereafter withstand a vacuum of a minimum of 30 psi in the impact area without deformation.

14. An impact resistant building panel comprising a foam core having interior and exterior sides;

a cementitious subpanel including an aggregate core having inner and outer faces, a first reinforcing mesh web adhered to an outer face of said aggregate core and a second impact resistant mesh web of a different material from said first mesh web adhered to an inner face of said aggregate core;

said subpanel being adhesively bonded to an exterior face of said foam core, capable of preventing penetration therethrough in an impact area engaged by an impacting wooden two by four, eight feet long, weighing approximately 8.5 pounds and moving endwise at 34 miles per hour, and thereafter withstand a vacuum of a minimum of 30 psi in the impact area without deformation.

15. An impact resistant building panel comprising a foam core having exterior and interior faces; and a cementitious subpanel having reinforced facings;

an impact resistant mesh web adhesively bonded between an exterior face of said foam core and a reinforced face of a subpanel, such building panel capable of preventing penetration therethrough in an impact area engaged by an impacting wooden two by four, eight feet long, weighing approximately 8.5 pounds and moving endwise at 34 miles per hour, and thereafter withstand a vacuum of a minimum of 30 psi in the impact area without deformation.

16. An impact resistant building panel comprising:

a cementitious subpanel having reinforced facings;

an impact resistant mesh; and a foam sub panel;

said cementitious subpanel and said foam subpanel being adhered together with said mesh adhered therebetween, such building panel capable of preventing penetration therethrough in an impact area engaged by an impacting wooden two by four, eight feet long, weighing approximately 8.5 pounds and moving endwise at 34 miles per hour, and thereafter withstand a vacuum of a minimum of 30 psi in the impact area without deformation.

* * * * *